US008100637B2

(12) United States Patent
Sinzaki

(10) Patent No.: US 8,100,637 B2
(45) Date of Patent: Jan. 24, 2012

(54) DOUBLE SUCTION TYPE CENTRIFUGAL FAN

(75) Inventor: Kouji Sinzaki, Aichi (JP)

(73) Assignee: Panasonic Corporation, Osaka (JP)

( * ) Notice: Subject to any disclaimer, the term of this patent is extended or adjusted under 35 U.S.C. 154(b) by 571 days.

(21) Appl. No.: 12/304,509

(22) PCT Filed: Aug. 23, 2007

(86) PCT No.: PCT/JP2007/066330

§ 371 (c)(1),
(2), (4) Date: Dec. 12, 2008

(87) PCT Pub. No.: WO2008/023752

PCT Pub. Date: Feb. 28, 2008

(65) Prior Publication Data

US 2009/0123285 A1 May 14, 2009

(30) Foreign Application Priority Data

Aug. 24, 2006 (JP) ..... 2006-227635

(51) Int. Cl.
*F04D 29/66* (2006.01)

(52) U.S. Cl. ..... 415/119

(58) Field of Classification Search ..... 415/119, 415/120, 124, 203, 204; 416/178; 181/202
See application file for complete search history.

(56) References Cited

U.S. PATENT DOCUMENTS

| | | | | |
|---|---|---|---|---|
| 5,746,577 | A * | 5/1998 | Ito et al. | 416/178 |
| 2002/0106289 | A1 | 8/2002 | Tanaka et al. | |
| 2003/0012649 | A1 * | 1/2003 | Sakai et al. | 415/206 |

FOREIGN PATENT DOCUMENTS

| | | | |
|---|---|---|---|
| JP | S49-95506 | U | 8/1974 |
| JP | S52-140408 | U | 10/1977 |
| JP | S53-80104 | U | 7/1978 |
| JP | S58-101297 | A | 6/1983 |
| JP | H03-175199 | A | 7/1991 |
| JP | H09-195980 | A | 7/1997 |
| JP | H09-195988 | A | 7/1997 |
| JP | 2001-140800 | A | 5/2001 |
| JP | H09-217700 | A | 12/2008 |

OTHER PUBLICATIONS

International Search Report of PCT Application NO. PCT/JP2007/066330 dated Oct. 2, 2007.

* cited by examiner

*Primary Examiner* — Alexander Gilman
(74) *Attorney, Agent, or Firm* — Panasonic Patent Center; Dhiren Odedra; Kerry Culpepper

(57) ABSTRACT

A double inlet centrifugal fan includes an impeller and fan inlet port. The impeller has a main plate connected to the drive shaft in a fan casing, fan side plates, and a plurality of blades between the main plate and each of the fan side plates. The fan inlet port has an opening corresponding to the inner diameter of the blades. The blades on the side of the larger pressure loss in the suction air passage to the fan inlet port have a smaller inner diameter than the blades on the side of the smaller pressure loss. This equalizes the total pressure increase in the blades along the drive shaft, resulting in a compact double inlet centrifugal fan capable of supplying the required air flow.

19 Claims, 11 Drawing Sheets

DOUBLE SUCTION TYPE CENTRIFUGAL FAN

TECHNICAL FIELD

The present invention relates to a double inlet centrifugal fan installed in an air passage of ventilators, air conditioners, dehumidifiers, humidifiers, air cleaners, and the like.

BACKGROUND ART

In conventional double inlet centrifugal fans such as shown in Patent Document 1 below, the fan casing is provided with a motor-side casing inlet port and an opposite-motor-side casing inlet port having a larger inner diameter than the motor-side casing inlet port.

The double inlet centrifugal fan of Patent Document 1 will be described as follows with reference to FIG. 13 which is a side view where a unit including the fan is installed and FIG. 14 which is a plan view of the unit.

As shown in FIGS. 13 and 14, box-shaped unit 106 is installed on attic 101 floor in such a manner as to be connected to suction-side duct 103 at unit air inlet 102 and to discharge-side duct 105 at unit air outlet 104. Unit air inlet 102 is provided on one side of unit 106 to draw in outdoor air, and unit air outlet 104 is provided on the other side thereof to supply the outdoor air into a room. Unit 106 includes double inlet centrifugal fan 112 and heat exchanger 113. Double inlet centrifugal fan 112 includes fan casing 107 and motor 108. Fan casing 107 includes opposite-motor-side casing inlet port 109 and motor-side casing inlet port 110. Motor 108 has an outer diameter 111 substantially equal to the diameter of opposite-motor-side casing inlet port 109. Motor-side casing inlet port 110 has a larger diameter than opposite-motor-side casing inlet port 109.

When double inlet centrifugal fan 112 is operated, outdoor 114 air is drawn into heat exchanger 113 through suction-side duct 103. After discharged from heat exchanger 113, some of the air passes through motor-side air passage 115 and is drawn through motor-side casing inlet port 110, whereas the other passes through opposite-motor-side air passage 116 and is drawn through opposite-motor-side casing inlet port 109. These air flows pass through discharge-side duct 105 via double inlet centrifugal fan 112 and are supplied indoors 120. Double inlet centrifugal fan 112 includes impeller 119 having disk-shaped main plate 118 and a plurality of blades on both sides of main plate 118. The blades have inner diameter 117 substantially equal to the diameter of motor-side casing inlet port 110.

As shown in Patent Document 2 below, some impellers that can be used in double inlet centrifugal fans of this type have blades whose main plate-side outlet angle is made smaller than their fan-side-plate-side outlet angle.

An impeller that can be used in double inlet centrifugal fans of this type is described as follows with reference to FIGS. 15 to 17A and 17B. FIGS. 15 and 16 are a plan view and a side view, respectively, of a conventional double inlet centrifugal fan. FIGS. 17A and 17B are enlarged side views of the fan; the former showing relative speed W1 of the main plate-side fluid and the latter showing relative speed W2 of the fan-side-plate-side fluid.

In double inlet centrifugal fan 132 shown in FIGS. 15 and 16, single inlet fan casing 126 includes outlet port 121, spiral scroll 122, casing side plates 123 on both sides of fan casing 126, and orifice 125 having casing inlet port 124 on one of casing side plates 123. Fan 132 further includes single inlet impeller 131 having disk-shaped main plate 128, annular fan side plates 129, and a plurality of blades 130 disposed between main plate 128 and each of side plates 129. Main plate 128 is connected to drive shaft 127 of fan casing 126.

Blades 130 have main-plate-side outlet angle 133 of $\alpha 1$ and fan-side-plate-side outlet angle 134 of $\alpha 2$ in the relation that $\alpha 1<\alpha 2$. When fan 132 is operated, the air drawn through casing inlet port 124 is discharged through outlet port 121 showing wind speed distribution 135 along blades 130.

As shown in the speed triangles of FIGS. 17A and 17B, when relative speed 136 of the main plate-side fluid is W1, relative speed 137 of the fan-side-plate-side fluid is W2, and circumferential speed 138 is U, W1 tends to be larger than W2 as shown in wind speed distribution 135. When circumferential component 139 of the absolute velocity of the main plate-side discharge current is CU1, and circumferential component 140 of the absolute velocity of the fan-side-plate-side discharge current is CU2, CU2 approaches CU1 because of the relation that $\alpha 1<\alpha 2$. This equalizes the total pressure increase in blades 130 along drive shaft 127.

When such a conventionally-shaped impeller is used in conventional fan 132, air flow is decreased due to the air passage resistance in the unit. Therefore, fan 132 uses a large-diameter motor to increase the revolution, thereby ensuring sufficient air flow. However, the motor with a larger outer diameter blocks the motor-side casing inlet port, requiring an increase in the diameter of the motor-side casing inlet port. As a result, the air passage area obtained by subtracting the area of the motor from the area of the motor-side casing inlet port is made equal to the area of the opposite-motor-side casing inlet port.

In this impeller, the blades on the motor side and the blades on the opposite motor side have a substantially equal inner diameter. And the casing inlet port on the motor side has a large diameter substantially equal to the inner diameter of the blades. The opposite-motor-side casing inlet port has air inlet resistance because it has a diameter smaller than the inner diameter of the blades. The resistance is reduced by using a large-diameter impeller so as to ensure sufficient air flow to the opposite-motor-side air passage. However, this results in an increases in the height of the fan casing and hence the height of the unit.

When the impeller that can be used in conventional double inlet centrifugal fan 132 is used in a single inlet fan, the current is guided to blades 130 through a single inlet port. As a result, the relative speeds of the fluids over the blades have a small difference along the drive shaft, so that the total pressure increase in the blades can be equalized along the drive shaft by adjusting the outlet angle.

When the impeller is used in a double inlet centrifugal fan, on the other hand, the current is guided to the blades on both sides of the main plate through two inlet ports. In this case, the motor arrangement on one side or the entire arrangement in the unit causes air passage resistance. This makes the relative speeds of the fluids over the blades largely different between both sides of the main plate. Consequently, the adjustment of the outlet angles cannot be fully accomplished only by changing them, and therefore it is difficult to equalize the total pressure increase in the blades along the drive shaft. Sufficient air flow is ensured by using a large-diameter impeller; however, this results in an increase in the height of the fan casing and hence the height of the unit.

Patent Document 1: Japanese Patent Unexamined Publication No. H03-175199

Patent Document 2: Japanese Patent Unexamined Publication No. H09-195988

SUMMARY OF THE INVENTION

A double inlet centrifugal fan of the present invention includes: a fan casing including an outlet port, a spiral scroll, and casing side plates on both side surfaces of the fan casing, each of the casing side plates having an orifice with a casing inlet port; an impeller including a disk-shaped main plate connected to a drive shaft in the fan casing, annular fan side plates on both sides of the main plate, and a plurality of blades between the main plate and each of the fan side plates; and fan inlet port having an opening corresponding to an inner diameter of the blades. The inner diameter of the blades on a side of a larger pressure loss in a suction air passage to the fan inlet port is smaller than the inner diameter of the blades on a side of a smaller pressure loss.

With this structure, the blades on the side of the larger pressure loss in the suction air passage to the fan inlet port have a smaller inner diameter than the blades on the side of the smaller pressure loss. This increases the relative speed of the fluid over the blades on the side of the larger pressure loss. Consequently, the relative speeds of the fluids over the blades on both sides of the main plate can be close to each other, thereby equalizing the total pressure increase in the blades along the drive shaft. This results in a compact double inlet centrifugal fan capable of supplying the required air flow.

REFERENCE MARKS IN THE DRAWINGS

Figure 1:
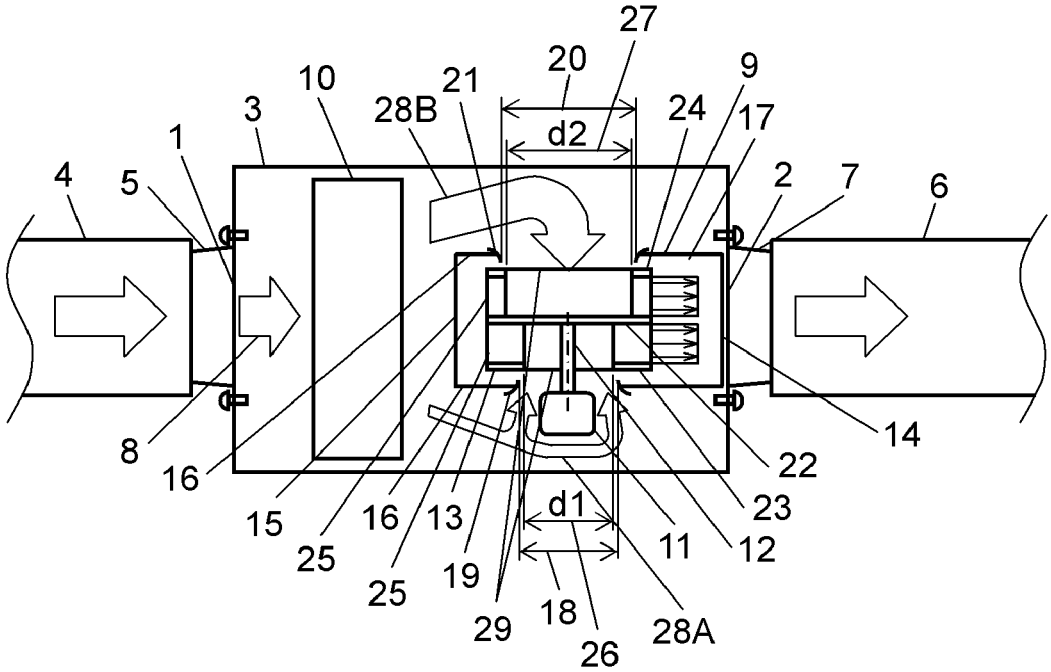
FIG. 1 is a plan view of a unit including a double inlet centrifugal fan according to a first embodiment of the present invention.

9, 70, 71, 72, 73, 74, 75 double inlet centrifugal fan
12 drive shaft
13, 93 impeller
14 outlet port
15 scroll
16 casing side plate
17 fan casing
18 motor-side casing inlet port
19 motor-side orifice
20 opposite-motor-side casing inlet port
21 opposite-motor-side orifice
22 main plate
23 motor-side fan side plate
24 opposite-motor-side fan side plate
25 blade
26 motor-side blade inner diameter
27 opposite-motor-side blade inner diameter
28A motor-side air passage
28B opposite-motor-side air passage
29 fan inlet port
30 motor-side outlet angle
31 opposite-motor-side outlet angle
42 motor-side blade length
43 inner circumferential area of the motor-side blades
44 opposite-motor-side blade length
45 inner circumferential area of the opposite-motor-side blades
52 blade outer diameter
56 motor-side inlet angle
57 opposite-motor-side inlet angle

DETAILED DESCRIPTION OF PREFERRED EMBODIMENTS

Embodiments of the present invention are described as follows with reference to accompanied drawings.

First Embodiment

Figure 2:
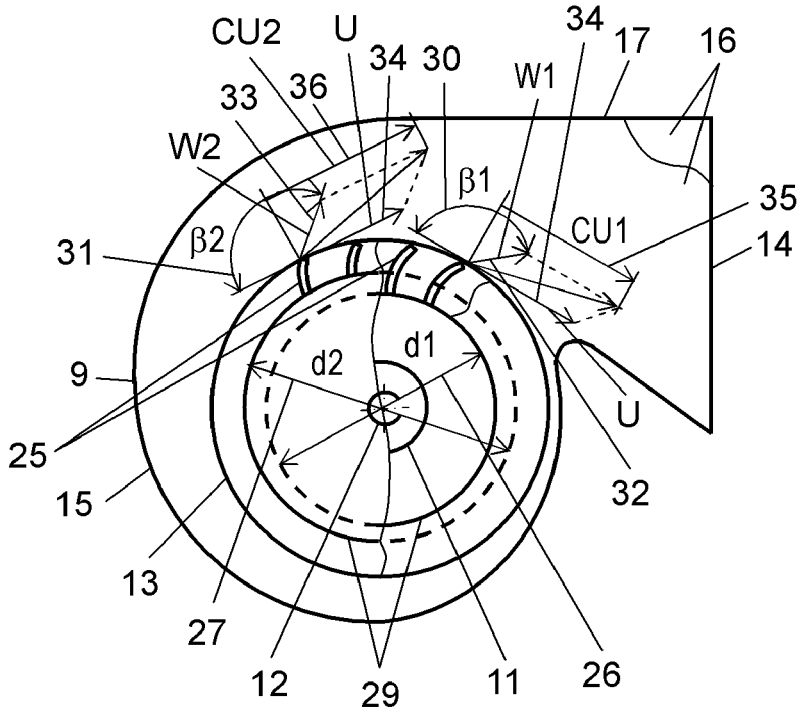
FIG. 2 is a side view of the fan according to the first embodiment.
Figure 3:
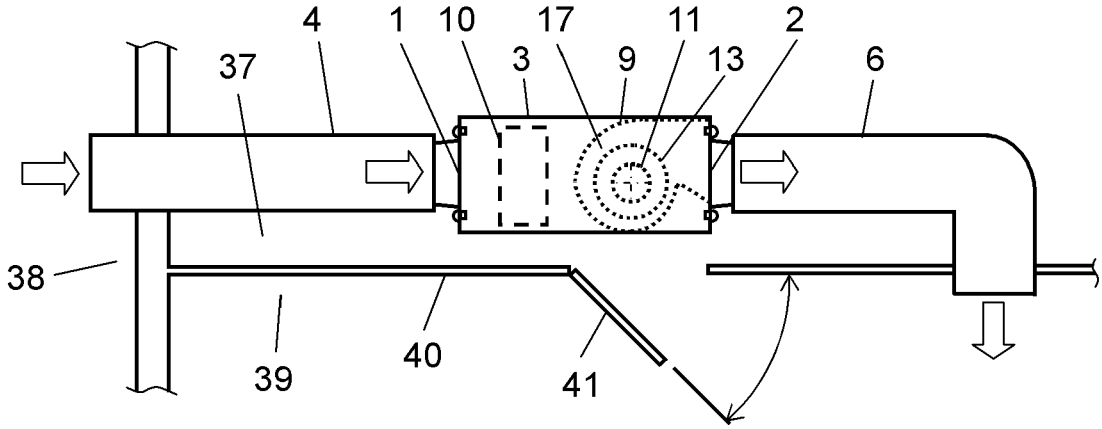
FIG. 3 is a side view where the unit including the fan according to the first embodiment is installed.
Figure 4:
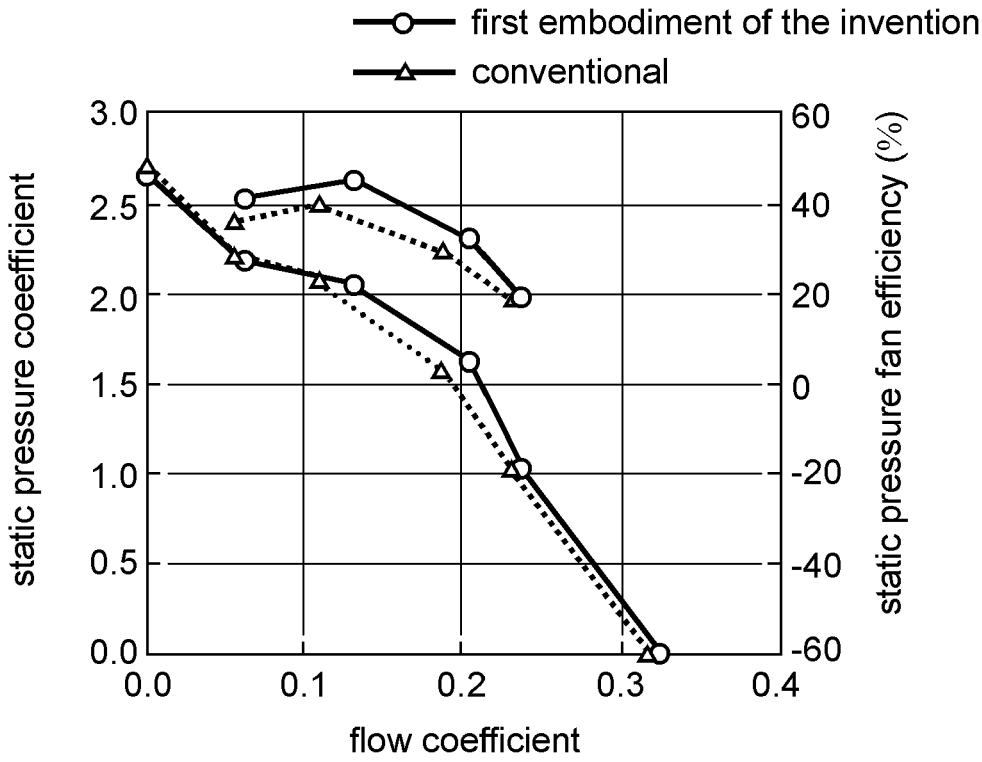
FIG. 4 is a non-dimensional characteristic diagram comparing performance between the fan according to the first embodiment and a conventional double inlet centrifugal fan.
Figure 5:
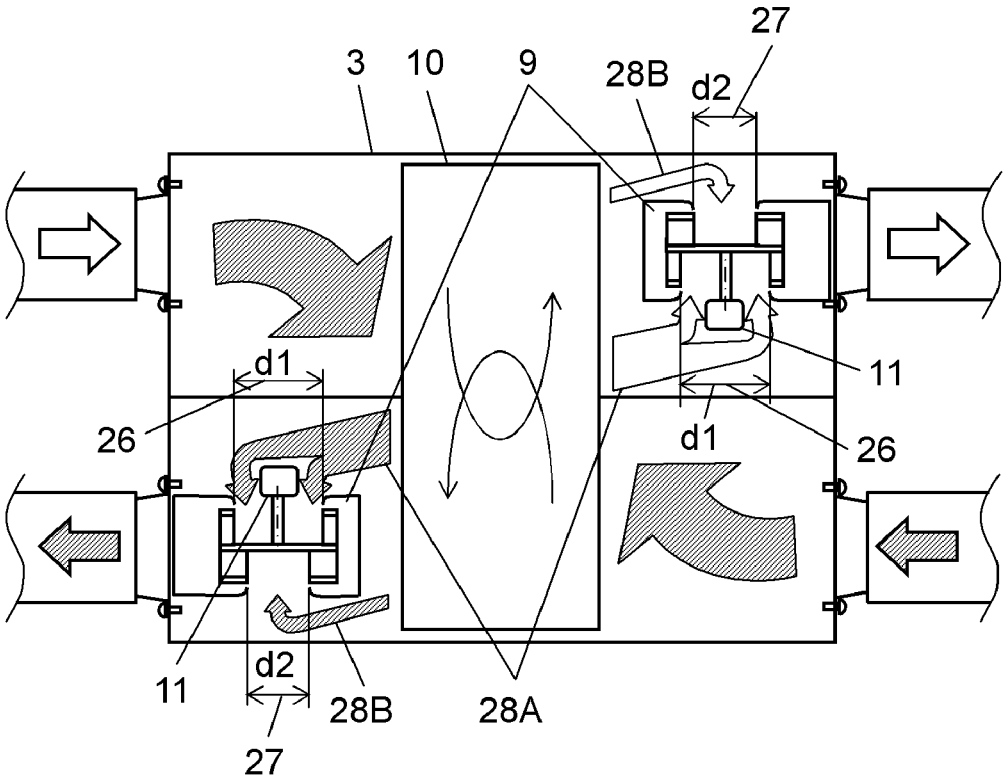
FIG. 5 is a plan view showing an application of the unit including the fan according to the first embodiment.

A first embodiment of the present invention is described as follows based on FIGS. 1 to 5. FIG. 1 is a plan view of a unit including a double inlet centrifugal fan of the first embodiment. FIG. 2 is a side view of the fan, FIG. 3 is a side view where the unit including the fan is installed, FIG. 4 is a non-dimensional characteristic diagram comparing performance between the fan and a conventional double inlet centrifugal fan, and FIG. 5 is a plan view showing an application of the unit including the fan.

As shown in FIGS. 1 and 2, box-shaped unit 3 is provided on its opposite side surfaces with unit air inlet 1 and unit air outlet 2. Unit air inlet 1 is connected to suction-side duct 4 through inlet adapter 5, and unit air outlet 2 is connected to discharge-side duct 6 through outlet adapter 7. Unit 3 includes double inlet centrifugal fan 9 and heat exchanger 10 which are placed on air passage 8 extending from unit air inlet 1 to unit air outlet 2.

Double inlet centrifugal fan 9 includes impeller 13 and fan casing 17. Impeller 13 is fixed to motor 11 via drive shaft 12. Fan casing 17 includes outlet port 14 facing unit air outlet 2, spiral scroll 15, and casing side plates 16 on both sides of fan casing 17. One of casing side plates 16 has motor-side orifice 19 with motor-side casing inlet port 18, and the other of casing side plates 16 has opposite-motor-side orifice 21 with opposite-motor-side casing inlet port 20.

Impeller 13 includes disk-shaped main plate 22, motor-side and opposite-motor-side fan side plates 23, 24, and a plurality of blades 25. Main plate 22 is connected to drive shaft 12. Motor-side and opposite-motor-side fan side plates 23 and 24 are annular and provided on both sides of main plate 22. Blades 25 are disposed between main plate 22 and each of fan side plates 23 and 24. Motor-side blade inner diameter 26 of d1 and opposite-motor-side blade inner diameter 27 of d2 are in the relation that d1<d2.

In double inlet centrifugal fan 9, there are relations that β1≈β2 where β1 represents motor-side outlet angle 30 and β2 represents opposite-motor-side outlet angle 31 which are the outlet angles at the air outlet ends of blades 25 and that d1<d2 where d1 represents motor-side blade inner diameter 26 and d2 represents opposite-motor-side blade inner diameter 27. The inlet angles at the air inlet ends of blades 25 indicate the motor-side inlet angle and the opposite-motor-side inlet angle.

It is preferable in terms of the reduction in inflow resistance to make motor-side casing inlet port 18 have a diameter substantially equal to motor-side blade inner diameter 26, and to make opposite-motor-side casing inlet port 20 have a diameter substantially equal to opposite-motor-side blade inner diameter 27.

As shown in FIG. 3, unit 3 is installed on attic 37 floor in such a manner as to be connected to suction-side duct 4 at unit air inlet 1 and to discharge-side duct 6 at unit air outlet 2. Thus, unit 3 includes heat exchanger 10 and double inlet centrifugal fan 9 having unit air inlet 1 on the inlet side and unit air outlet 2 on the outlet side. Double inlet centrifugal fan 9 includes fan casing 17, motor 11, and impeller 13.

When double inlet centrifugal fan 9 is operated, outdoor 38 air is drawn into heat exchanger 10 through suction-side duct 4 and temperature-controlled therein. After discharged from heat exchanger 10, the air passes through discharge-side duct 6 via double inlet centrifugal fan 9 including impeller 13 and is supplied indoors 39. Attic 37 and indoors 39 are separated by ceiling material 40, which has ceiling access door 41 below unit 3.

The air flow drawn through unit air inlet 1 is divided into motor-side air passage 28A and opposite-motor-side air passage 28B. When these air flows are drawn through fan inlet port 29 on the inner diameter sides of blades 25, opposite-motor-side air passage 28B has a smaller pressure loss than motor-side air passage 28A because of the absence of collision of air against motor 11. Since opposite-motor-side air passage 28B has a larger distribution of air flow, opposite-motor-side blade inner diameter 27 can be made large to reduce the inflow resistance of fan inlet port 29. This results in compact double inlet centrifugal fan 9 capable of supplying the required air flow without increasing the size of impeller 13.

The same effect can be provided by replacing heat exchanger 10 by a duct fan with a sound absorbing box including sound absorbing material such as glass wool.

The following is based on the assumption that relative speed 32 of the motor-side fluid is w1, relative speed 33 of the opposite-motor-side fluid is w2, and circumferential speed 34 is u. Of the air reaching fan inlet port 29, the air flow flowing through motor-side blade inner diameter 26 has a larger pressure loss in the air passage due to the presence of collision of air against motor 11 and hence a smaller distribution of air flow than the air flow flowing through opposite-motor-side blade inner diameter 27. Because of the relation that d1<d2, the relative speeds of the fluids, which are approximately determined by dividing the air flow flowing through motor-side blade inner diameter 26 or opposite-motor-side blade inner diameter 27 by the area of each fan inlet port 29, can be made close to the relation that w1≈w2.

As shown in the speed triangles of FIG. 2, when circumferential component 35 of the absolute velocity of the motor-side discharge current is cu1, and circumferential component 36 of the absolute velocity of the opposite-motor-side discharge current is cu2, cu1 approaches cu2. As a result, the total pressure increase in blades 25 can be equalized between the motor side and the opposite motor side along drive shaft 12. This results in compact double inlet centrifugal fan 9 capable of supplying the required air flow without increasing the size of impeller 13.

The same effect can be provided in the case where the values of β1 and β2 are differed from each other according to the difference between w1 and w2 in blades 25.

As double inlet centrifugal fan 9 gets more compact, unit 3 can be smaller in height, allowing attic 37 to have a small vertical space and securing a high-ceilinged space indoors 39. As a result, double inlet centrifugal fan 9 can be easily removed for maintenance through small ceiling access door 41.

FIG. 4 shows the operational results of a conventional double inlet centrifugal fan shown as "conventional" in FIG. 4 (motor-side and opposite-motor-side blade inner diameters: 194 mm), and double inlet centrifugal fan 9 of the first embodiment (the motor-side blade inner diameter: 187 mm and the opposite-motor-side blade inner diameter: 194 mm). In FIG. 4, the vertical axis represents static pressure coefficient and static pressure fan efficiency, and the horizontal axis represents flow coefficient.

These impellers with a motor having a pole number of 4 and an outer diameter of 120 mm have been operated in the following conditions: a blade outer diameter of 220 mm, a motor-side blade length of 77 mm, an opposite-motor-side blade length of 117 mm, an outlet angle of 178° at the air outlet end of the blades, and an inlet angle of 115° at the air inlet end of the blades.

As shown in FIG. 4, the fan of the first embodiment has a higher static pressure coefficient when the flow coefficient is in the range of 0.1 to 0.24 and also has a higher static pressure fan efficiency in the entire range of the flow coefficient than the conventional fan. The reason for this is that, as described above, the inflow resistance at the inlet port of the impeller is low enough to equalize the total pressure increase in the blades along drive shaft 12.

As shown in FIG. 5, when unit 3 includes two fans 9 in addition to heat exchanger 10, motor-side air passage 28A has a smaller pressure loss than opposite-motor-side air passage 28B because of its larger width.

In the aforementioned structure, there is no difference in action and effect when motor-side blade inner diameter 26 of d1 is made larger than opposite-motor-side blade inner diameter 27 of d2.

Second Embodiment

Figure 6:
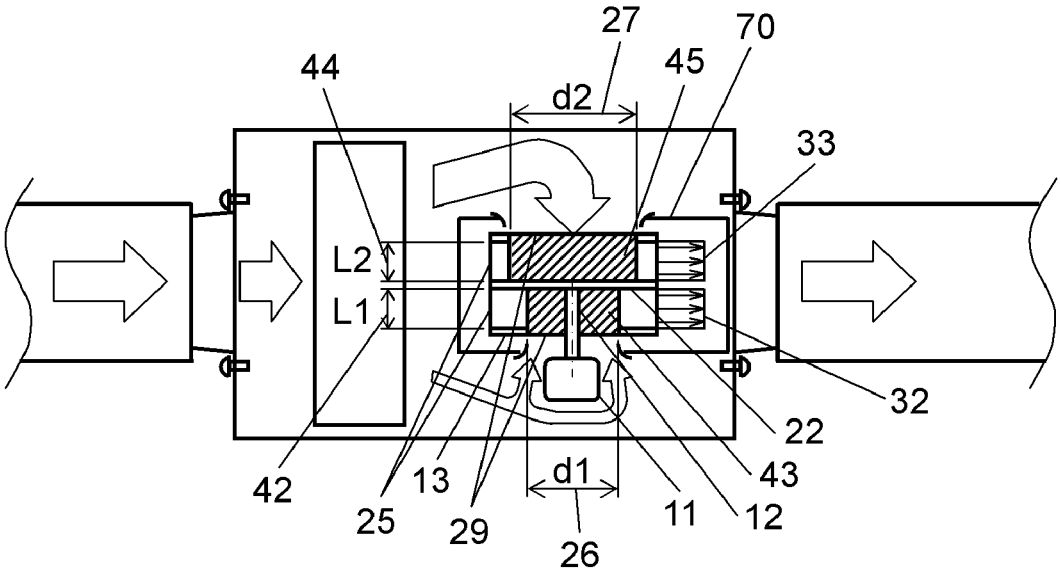
FIG. 6 is a plan view of unit including a double inlet centrifugal fan according to a second embodiment of the present invention.

FIG. 6 is a plan view of a unit including a double inlet centrifugal fan of a second embodiment of the present invention. Like components are labeled with like reference numerals with respect to the first embodiment, and the description thereof will be omitted.

In double inlet centrifugal fan 70 of the second embodiment shown in FIG. 6, inner circumferential area 43 of the motor-side blades is determined by the product of motor-side blade length 42 of L1 and motor-side blade inner diameter 26, and inner circumferential area 45 of the opposite-motor-side blades is determined by the product of opposite-motor-side blade length 44 of L2 and opposite-motor-side blade inner diameter 27. Inner circumferential area 43 of the motor-side blades is made smaller than inner circumferential area 45 of the opposite-motor-side blades.

Of the air reaching fan inlet port 29, the air flow flowing through motor-side blade inner diameter 26 has a larger pressure loss due to the presence of collision of air against motor 11 and hence a smaller distribution of air flow than the air flow flowing through opposite-motor-side blade inner diameter 27. The relative speed of a fluid over the blades is approximately determined by dividing the air flow flowing through either motor-side blade inner diameter 26 or opposite-motor-side blade inner diameter 27 by the inner circumferential area of the blades. In this case, relative speed 32 of the motor-side fluid over the blades on the side of the larger pressure loss can substantially be made equal to relative speed 33 of the opposite-motor-side fluid over the blades on the side of the smaller pressure loss. As a result, the total pressure increase in blades 25 can be equalized between the motor side, which is the direction of drive shaft 12, and the opposite motor side. This results in compact double inlet centrifugal fan 70 capable of supplying the required air flow without increasing the size of impeller 13.

Third Embodiment

Figure 7:
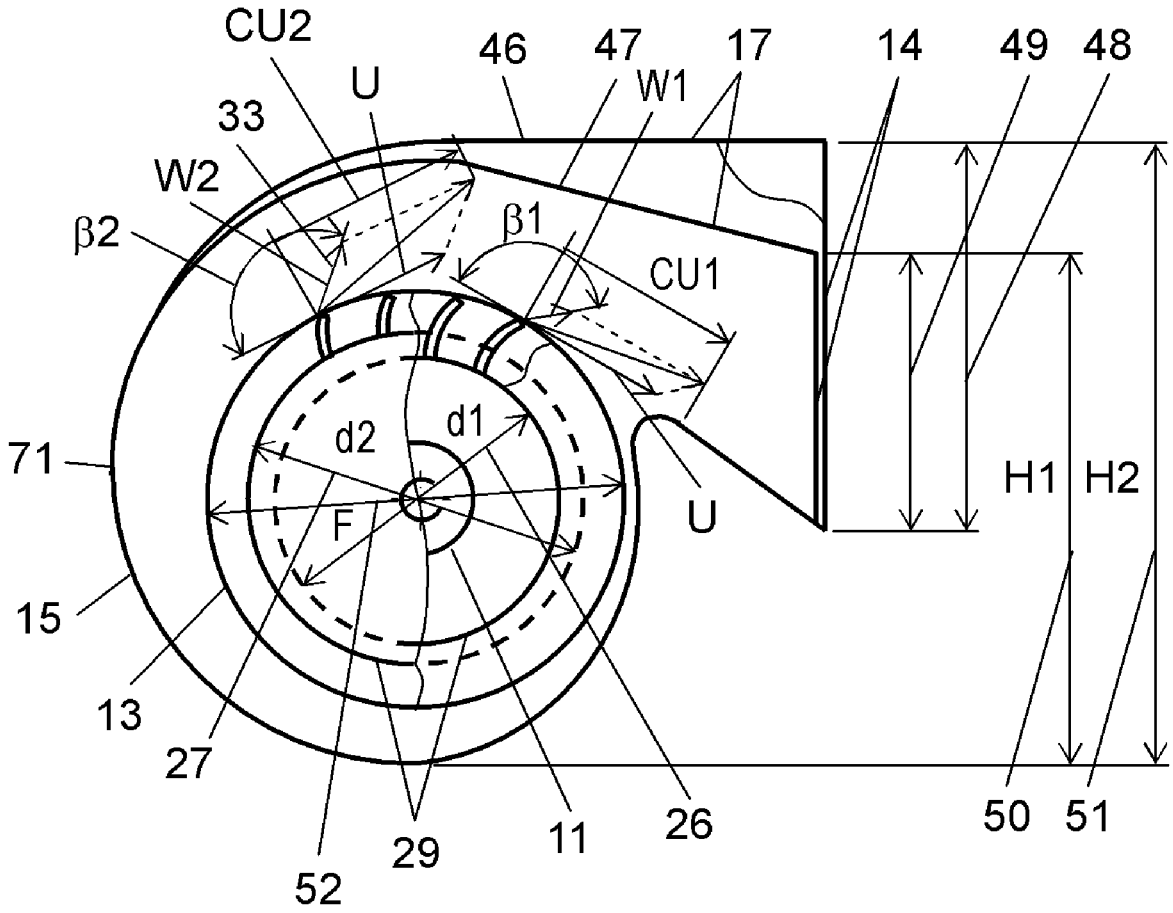
FIG. 7 is a side view of a double inlet centrifugal fan according to a third embodiment of the present invention.

FIG. 7 is a side view of a double inlet centrifugal fan of a third embodiment of the present invention. Like components are labeled with like reference numerals with respect to the first and second embodiments, and the description thereof will be omitted.

Double inlet centrifugal fan 71 shown in FIG. 7 includes spiral scroll 15 consisting of opposite-motor-side scroll 46 and motor-side scroll 47 having a smaller enlarged angle than opposite-motor-side scroll 46. In double inlet centrifugal fan 71, outlet port 14 consists of opposite-motor-side outlet port 48 and motor-side outlet port 49 smaller than opposite-motor-side outlet port 48. Double inlet centrifugal fan 71 further includes fan casing 17 and impeller 13. In fan casing 17, motor-side outlet port height 50 of H1 is smaller than opposite-motor-side outlet port height 51 of H2. Impeller 13 has blade outer diameter 52 of F.

In the aforementioned structure, of the air reaching fan inlet port 29, the air flow flowing through motor-side blade inner diameter 26 has a larger pressure loss in the air passage due to the presence of collision of air against motor 11 and hence a smaller distribution of air flow than the air flow flowing through opposite-motor-side blade inner diameter 27. For the purpose of improving maintenance performance of motor 11, the distribution of air flow flowing through motor-side blade inner diameter 26 might be further reduced by placing double inlet centrifugal fan 71 closer to the motor 11-side surface of unit 3 or by changing the position, direction, or the like of heat exchanger 10. In this case, because of the relation that d1<d2, relative speed W1 of the fluid approximately determined by dividing the air flow by the area of fan inlet port 29 can be approached to w2, while maintaining the relation that w1<w2.

The empirical values indicate that when double inlet centrifugal fan 71 is designed based on the value of the larger relative speed w2, the preferable value of H2 is 1.4 to 1.8 F, and that the preferable enlarged angle of opposite-motor-side scroll 46 is 7° to 9°.

When double inlet centrifugal fan 71 is designed based on the value of the smaller relative speed w1, it is known that the preferable enlarged angle of motor-side scroll 47 is 5° to 7°. The enlarged angle of motor-side scroll 47, which is smaller than the enlarged angle of opposite-motor-side scroll 46, can be determined subject to the condition that w1 is smaller than w2. This results in compact double inlet centrifugal fan 71 capable of supplying the required air flow.

Figure 8:
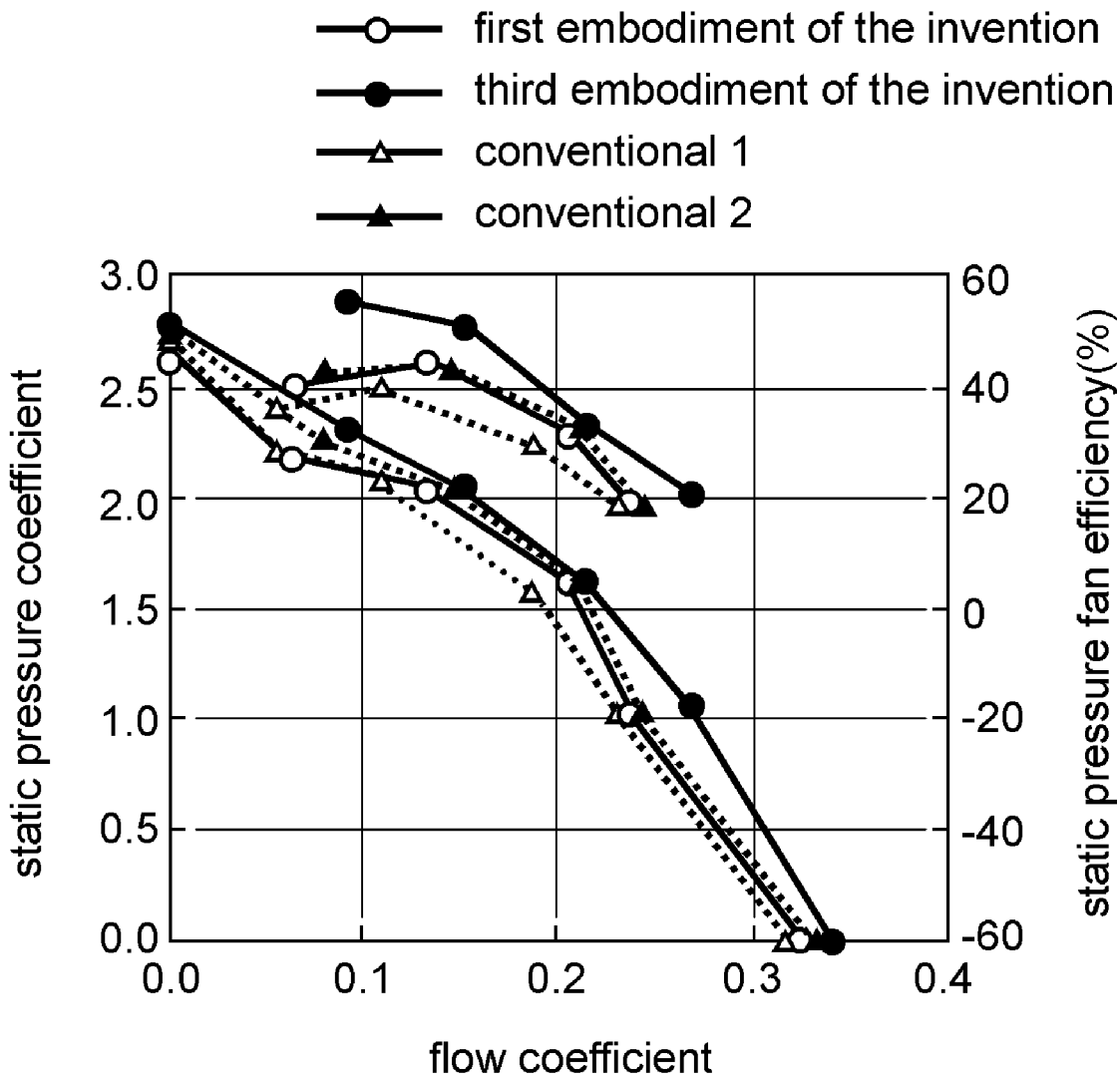
FIG. 8 is a non-dimensional characteristic diagram comparing performance between the fan according to the third embodiment and conventional double inlet centrifugal fans.

FIG. 8 shows operational results of a conventional double inlet centrifugal fan shown as "conventional 1" in FIG. 8 (H2: 1.4 F, an enlarged angle of the scroll: 9°, motor-side and opposite-motor-side blade inner diameters: 194 mm) and double inlet centrifugal fan 71 of the third embodiment (H2: 1.4 F; the enlarged angle of the opposite-motor-side scroll: 9°, the enlarged angle of the motor-side scroll: 6°, the motor-side blade inner diameter: 187 mm, and the opposite-motor-side blade inner diameter: 194 mm). In FIG. 8, the vertical axis represents static pressure coefficient and static pressure fan efficiency, and the horizontal axis represents flow coefficient.

For effect comparison, FIG. 8 further shows the operational results of another conventional double inlet centrifugal fan shown as "conventional 2" in FIG. 8. The "conventional 2" is a combination of the "conventional 1" and design conditions of the third embodiment, that is, H2: 1.4 F, the enlarged angle of the opposite-motor-side scroll: 9° and the enlarged angle of the motor-side scroll: 6°. The impellers of these conventional fans with a motor having a pole number of 4 and an outer diameter of 120 mm have been operated in the following conditions: a blade outer diameter of 220 mm, a motor-side blade length of 77 mm, an opposite-motor-side blade length of 117 mm, an outlet angle of 178° at the air outlet end of the blades, an inlet angle of 115° at the air inlet end of the blades.

As shown in FIG. 8, the fans of the first and third embodiments have higher static pressure coefficients when the flow coefficient is in the range of 0 to 0.34 and also have higher static pressure fan efficiencies. The reason for this is that, as described above, when the air flow passing through the blades on the side of the larger pressure loss is smaller than the air flow passing through the blades on the side of the smaller pressure loss, the enlarged angles of the scrolls can be controlled according the respective air flows.

The conventional fan shown as the "conventional 2" in FIG. 8, which is a combination of the "conventional 1" and the design conditions of the third embodiment, also shows some effect; however, the effect is small when the flow coefficient is 0.24 and over. This indicates that the fan of the third embodiment is highly effective.

Fourth Embodiment

Figure 9:
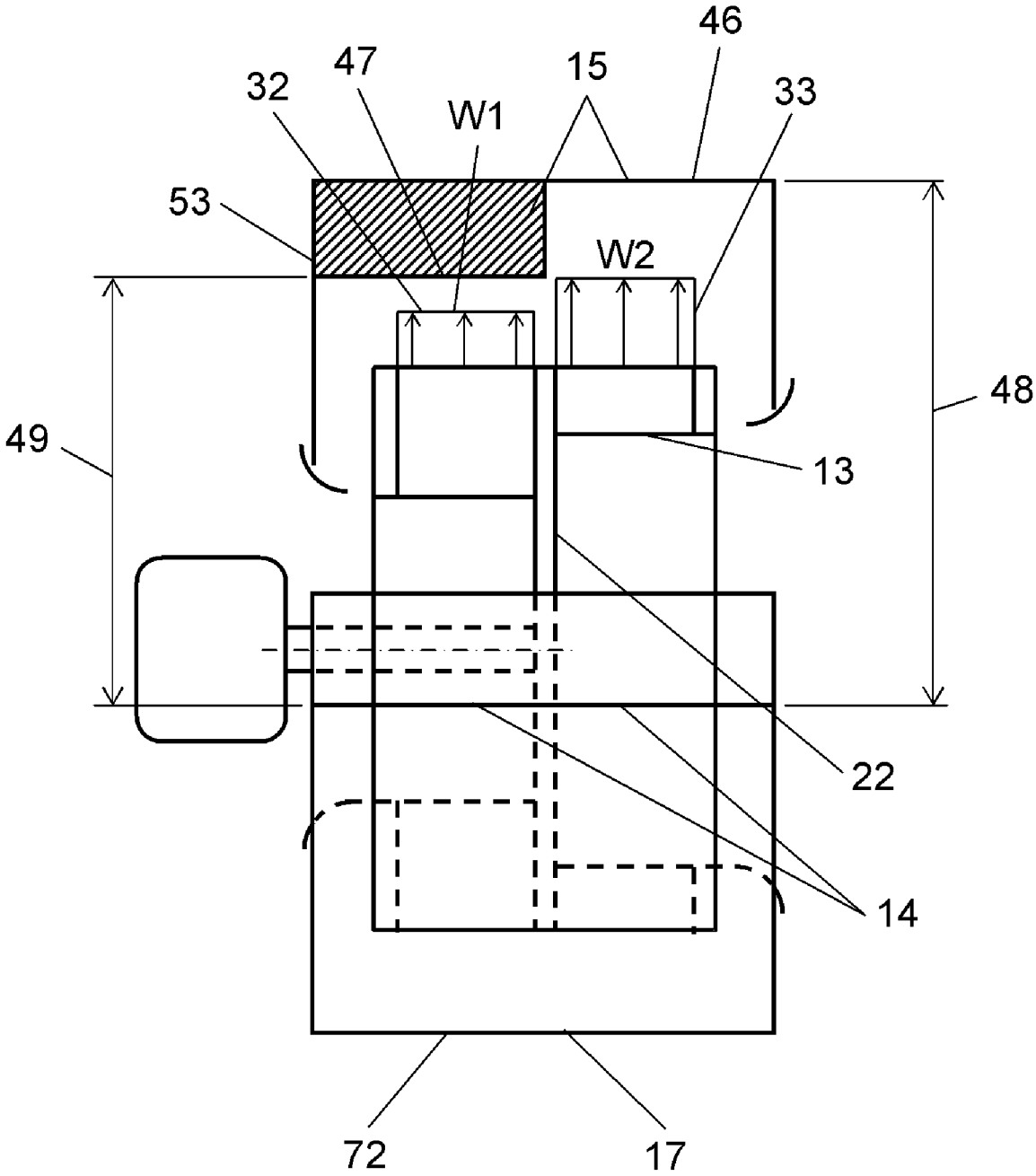
FIG. 9 is a front view of a double inlet centrifugal fan according to a fourth embodiment of the present invention.

FIG. 9 is a front view of a double inlet centrifugal fan of a fourth embodiment of the present invention. In double inlet centrifugal fan 72 shown in FIG. 9, spiral scroll 15 of fan casing 17 includes motor-side scroll plate 53 which divides spiral scroll 15 substantially in the same plane as main plate 22 of impeller 13 with main plate 22 disposed therebetween. Double inlet centrifugal fan 72 includes opposite-motor-side scroll 46 and motor-side scroll 47 having a smaller enlarged angle than opposite-motor-side scroll 46. Outlet port 14 consists of opposite-motor-side outlet port 48 and motor-side outlet port 49 smaller than opposite-motor-side outlet port 48.

When the relative speed w1 of the motor-side fluid and the relative speed w2 of the opposite-motor-side fluid are in the relation that w1<w2, the enlarged angle of motor-side scroll 47, which is smaller than the enlarged angle of opposite-motor-side scroll 46, can be determined subject to the relation that w1 is smaller than w2. The enlarged angles of scrolls 46 and 47 can be controlled according to the respective air flows by fixing motor-side scroll plate 53 to fan casing 17 simply by screwing, spot-welding, caulking, or the like. This results in compact double inlet centrifugal fan 72 capable of supplying the required air flow without increasing the size of impeller 13.

Fifth Embodiment

Figure 10:
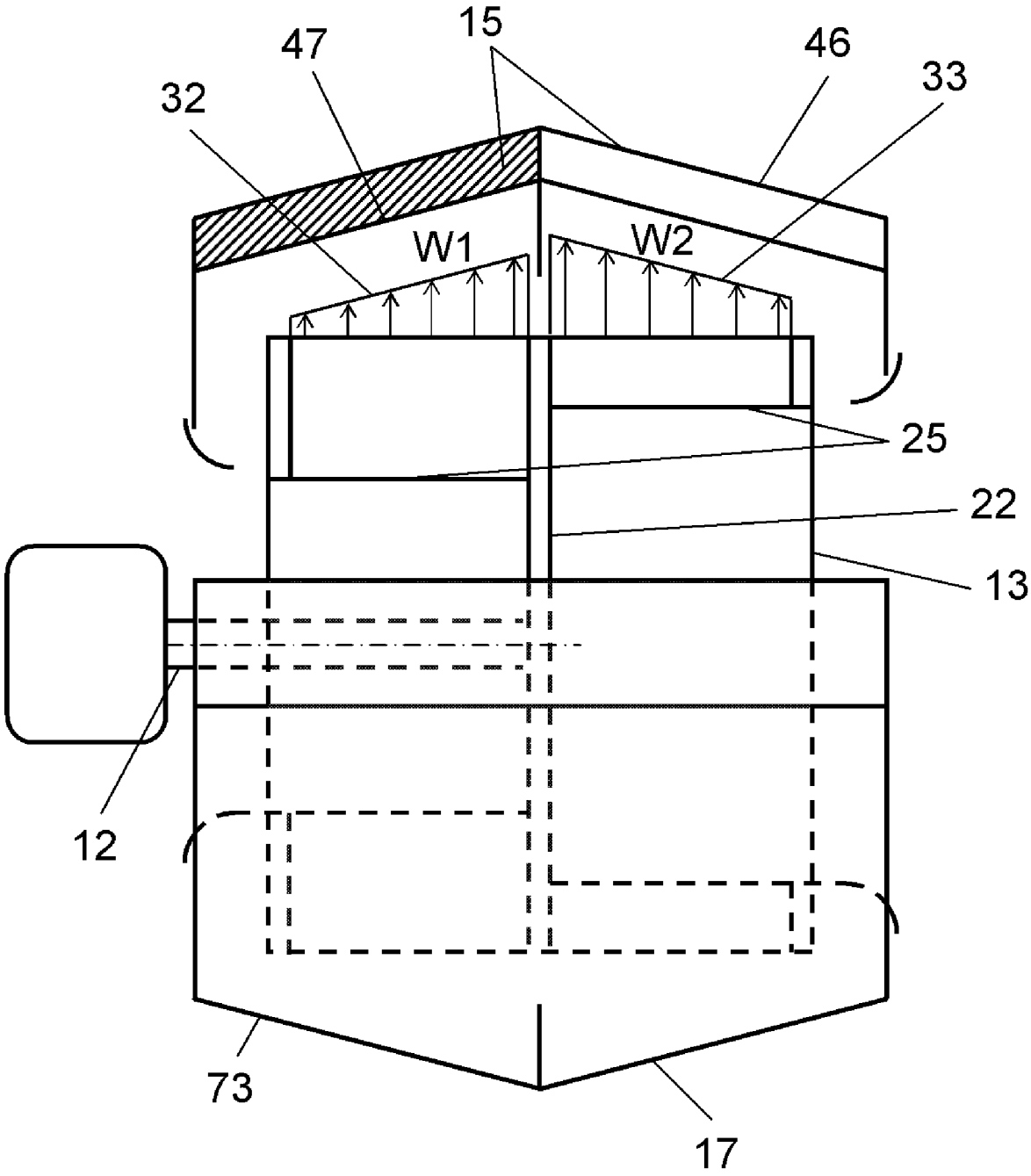
FIG. 10 is a front view of a double inlet centrifugal fan according to a fifth embodiment of the present invention.

FIG. 10 is a front view of a double inlet centrifugal fan of a fifth embodiment of the present invention. In double inlet centrifugal fan 73 of FIG. 10, fan casing 17 includes opposite-motor-side scroll 46 and motor-side scroll 47 having a smaller enlarged angle than opposite-motor-side scroll 46. Opposite-motor-side scroll 46 and motor-side scroll 47 are inclined with respect to drive shaft 12 increasingly toward main plate 22 of impeller 13.

In the aforementioned structure, as blades 25 of impeller 13 have a larger width, w1 and w2 tend to increase toward main plate 22. The enlarged angles of the scrolls can be controlled according as the air flow passing through blades 25 gradually changes along drive shaft 12. This results in compact double inlet centrifugal fan 73 capable of supplying the required air flow without increasing the size of impeller 13.

Sixth Embodiment

Figure 11:
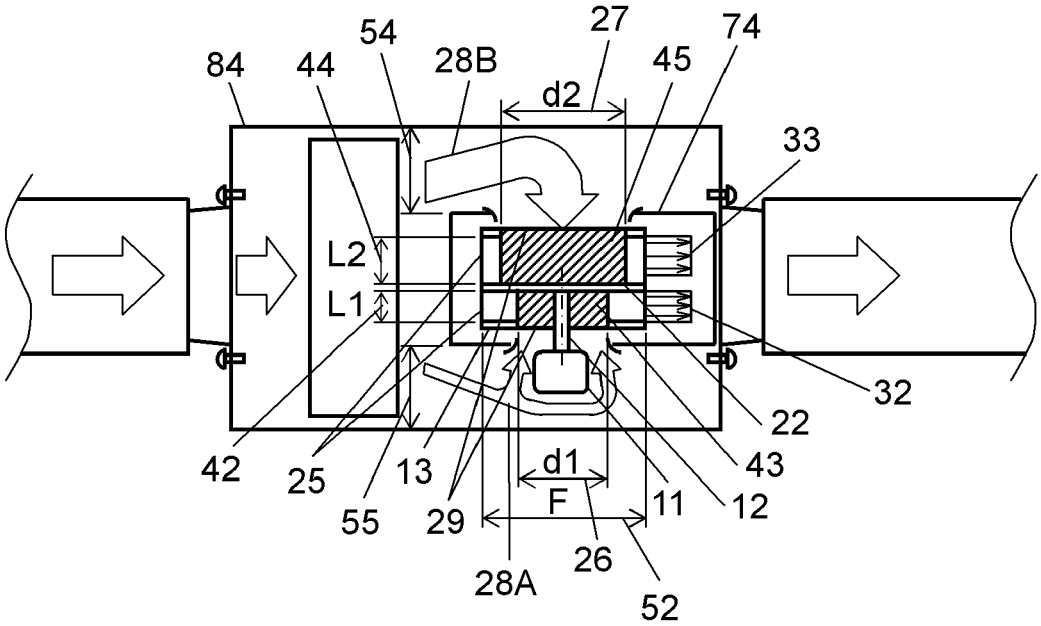
FIG. 11 is a plan view of a unit including a double inlet centrifugal fan according to a sixth embodiment of the present invention.

FIG. 11 is a plan view of a unit including a double inlet centrifugal fan of a sixth embodiment of the present invention.

In double inlet centrifugal fan 74 shown in FIG. 11, opposite-motor-side blade length 44 of L2 is larger than motor-side blade length 42 of L1. Double inlet centrifugal fan 74 includes impeller 13 having inner circumferential area 43 of the motor-side blades which is determined by the product of L1 and motor-side blade inner diameter 26, inner circumferential area 45 of the opposite-motor-side blades which is determined by the product of L2 and opposite-motor-side blade inner diameter 27, and blade outer diameter 52 of F. Double inlet centrifugal fan 74 is installed in unit 84 in such a manner as to make opposite-motor-side air passage width 54 larger than motor-side air passage width 55.

In the aforementioned structure, opposite-motor-side air passage width 54 is made larger than motor-side air passage width 55 so that the pressure loss of opposite-motor-side air passage 28B, which is originally smaller than that of motor-side air passage 28A can be further reduced. Of the air reaching fan inlet port 29, the air flow flowing through motor-side blade inner diameter 26 has a larger pressure loss due to the presence of collision of air against motor 11 and hence a smaller distribution of air flow than the air flow flowing through opposite-motor-side blade inner diameter 27.

When the relative speed of a fluid is approximately determined by dividing the air flow by the inner circumferential area of each blade, opposite-motor-side blade length 44 is made larger than motor-side blade length 42. This makes relative speed 32 of the motor-side fluid over the blades on the side of the larger pressure loss substantially equal to relative speed 33 of the opposite-motor-side fluid over the blades on the side of the smaller pressure loss. As a result, the total pressure increase in blades 25 can be equalized between the motor side and the opposite motor side along drive shaft 12. This results in compact double inlet centrifugal fan 74 capable of supplying the required air flow without increasing the size of impeller 13.

This structure allows double inlet centrifugal fan 74 to be placed closer to the motor 11-side surface of unit 84. As a result, the working distance to remove motor 11 from unit 84 can be reduced, thereby improving maintenance performance.

The empirical value indicates that the preferable length of the blades is 0.3 times to 0.8 times the blade outer diameter F. When this value is applied to the present invention, the ratio of L1 to L2 is minimum when L1=0.3 F and L2=0.8 F. As a result, L1/L2=0.3 F/0.8 F=0.38.

Assuming that air flow decrease caused by the loss due to the collision of air against motor 11 is 20%, the air flow ratio can be calculated proportionately to the width ratio of the blades. Consequently, the ratio of L1 to L2 is maximum when L1=0.8 F×0.8 (corresponding to 20% of air flow decrease) and L2=0.8 F. As a result, L1/L2=(0.8 F×0.8)/0.8 F=0.8. Therefore, it is preferable that blade length L1 on the side of the larger pressure loss in the suction air passage to fan inlet port 29 is 38% to 80% of blade length L2 on the side of the smaller pressure loss. As a result, the dimension of blades 25 along drive shaft 12 can be properly reduced, while making the relative speeds of the fluids over blades 25 on both sides of main plate 22 close to each other. This results in compact double inlet centrifugal fan 74.

When the aforementioned empirical value is applied to the present invention, the ratio of the blade length to F is maximum when L2=0.8 F. Assuming that air flow decrease caused by the loss due to the collision of air against motor 11 is 20%, the air flow ratio can be calculated proportionately to the width ratio of the blades. As a result, the ratio of the blade length to F is minimum when L1=0.3 F×0.8 (corresponding to 20% of air flow decrease)=0.24 F. Therefore, it is preferable that the length of each blade is 20% to 80% of the blade outer diameter F. As a result, the dimension of blades 25 along drive shaft 12 can be properly reduced with respect to blade outer diameter 52 while making the relative speeds of the fluids over blades 25 on both sides of main plate 22 close to each other. This results in compact double inlet centrifugal fan 74.

Seventh Embodiment

Figure 12:
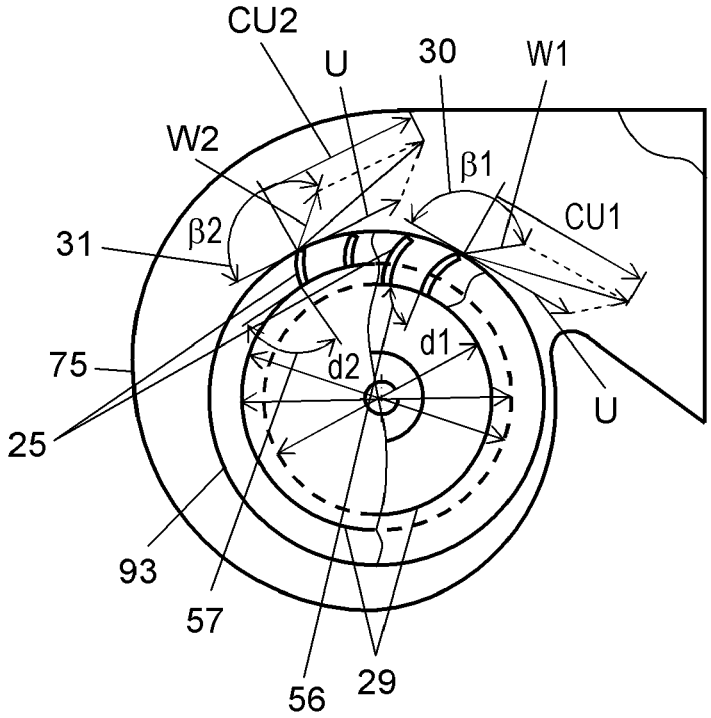
FIG. 12 is a side view of a double inlet centrifugal fan according to a seventh embodiment of the present invention.
Figure 13:
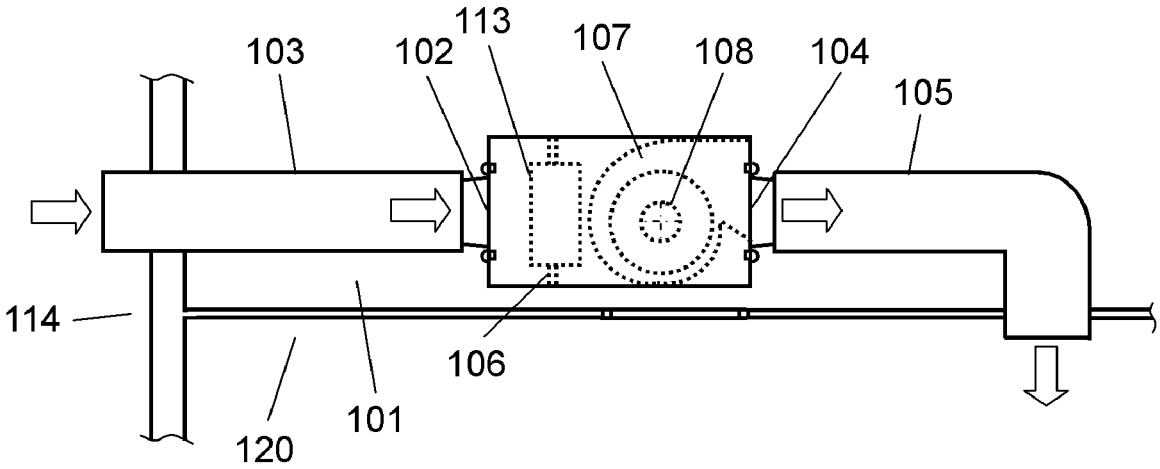
FIG. 13 PRIOR ART
FIG. 13 is a side view where a unit including a conventional double inlet centrifugal fan is installed.
Figure 14:
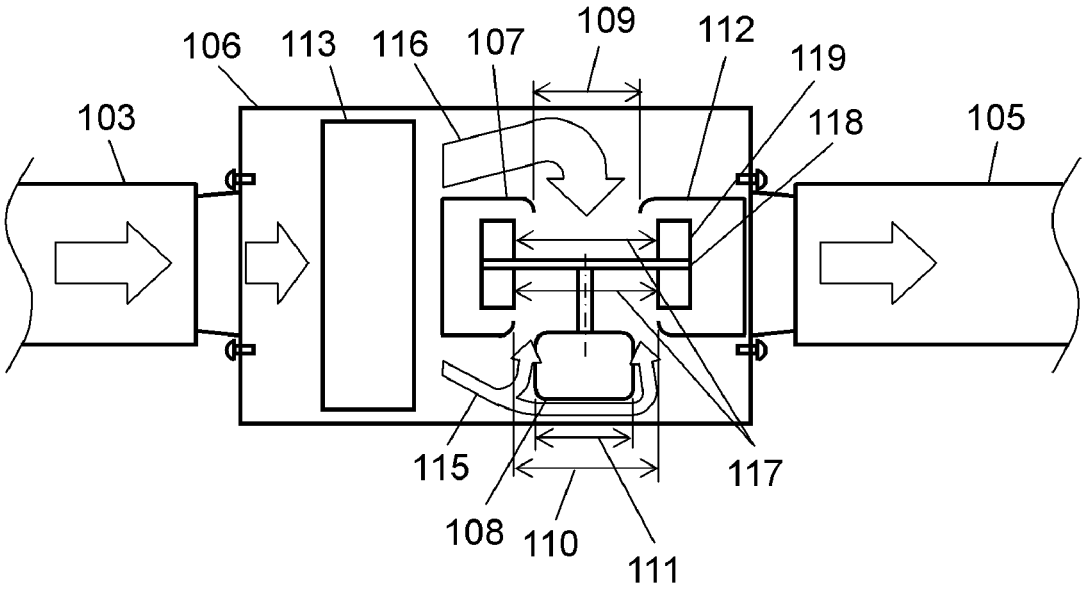
FIG. 14 PRIOR ART
FIG. 14 is a plan view of the unit including the conventional fan.
Figure 15:
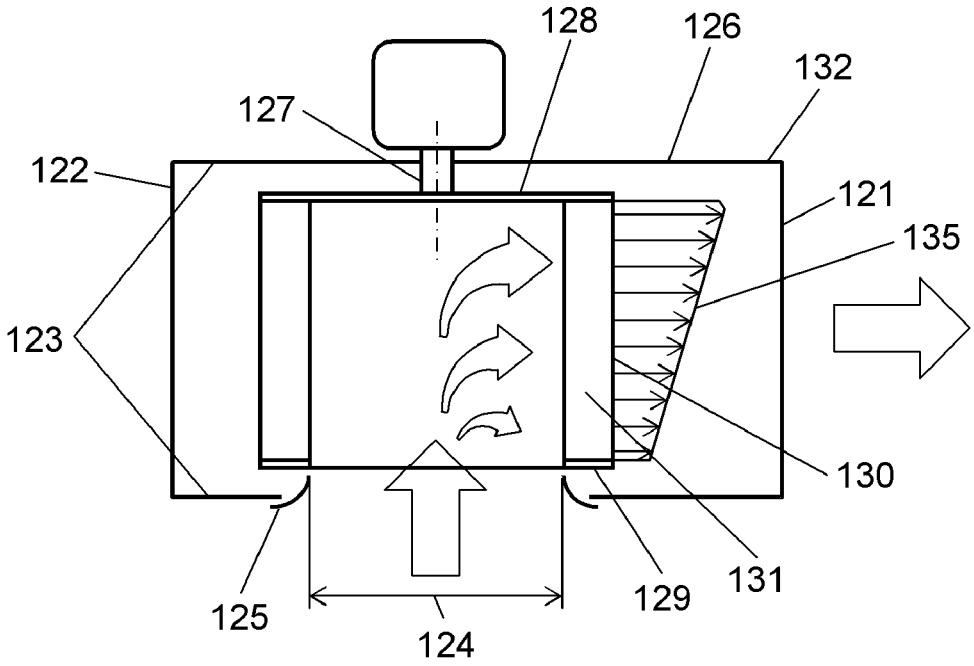
FIG. 15 PRIOR ART
FIG. 15 is a plan view of the conventional fan.
Figure 16:
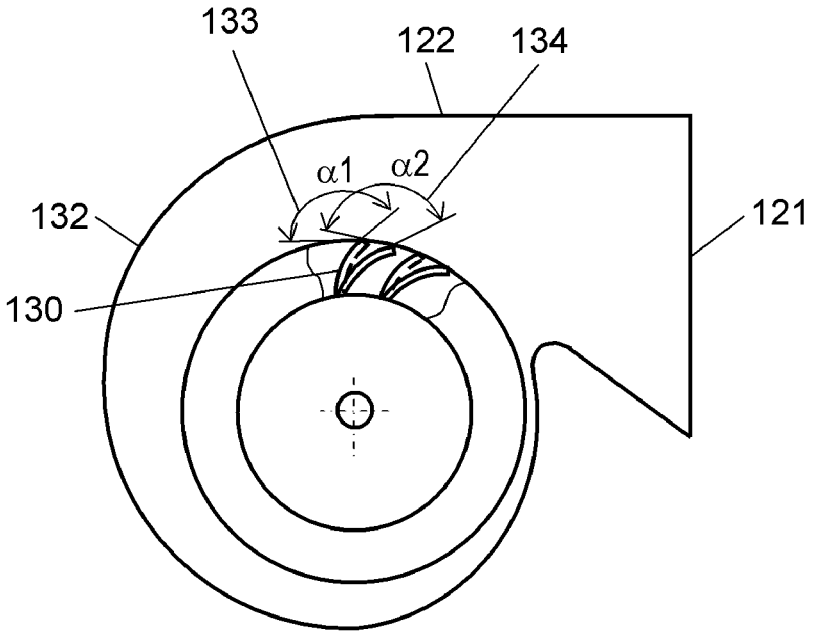
FIG. 16 PRIOR ART
FIG. 16 is a side view of the conventional fan.
Figure 17A:
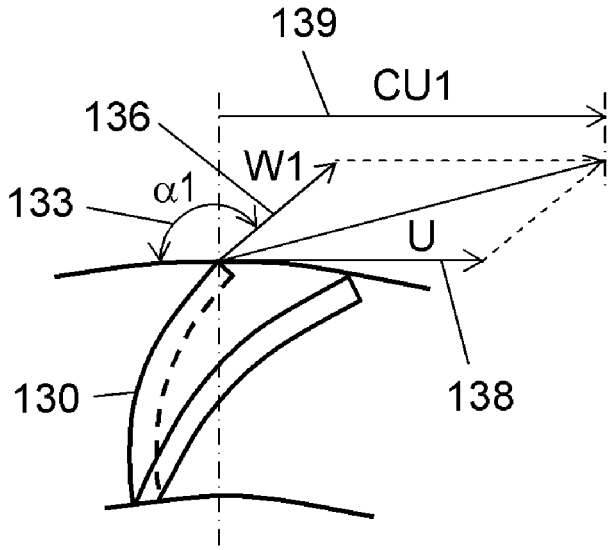
FIG. 17A PRIOR ART
FIG. 17A is an enlarged side view of the conventional fan in which the main plate-side fluid has a relative speed of W1.
Figure 17B:
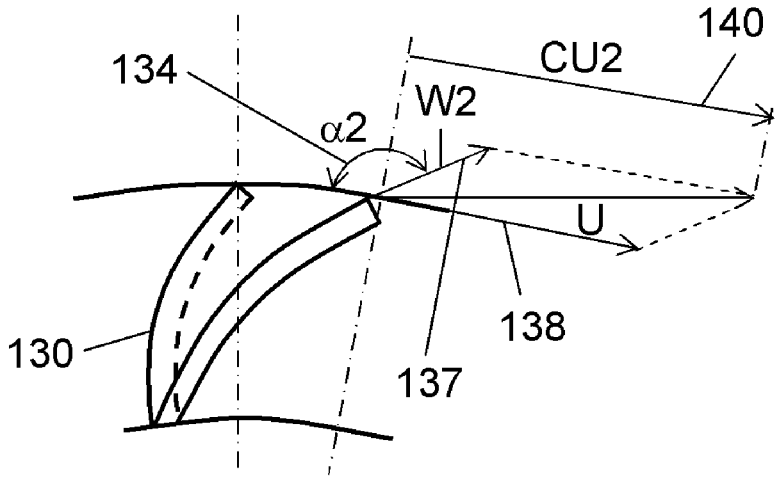
FIG. 17B PRIOR ART
FIG. 17B is an enlarged side view of the conventional fan in which the fan-side-plate-side fluid has a relative speed of W2.

FIG. 12 is a side view of a double inlet centrifugal fan of a seventh embodiment of the present invention.

Double inlet centrifugal fan 75 shown in FIG. 12 includes blades 25, which are set to have motor-side outlet angle 30, opposite-motor-side outlet angle 31, motor-side inlet angle 56, and opposite-motor-side inlet angle 57. Motor-side and opposite-motor-side inlet angles 56 and 57 are inlet angles at the air inlet ends of blades 25.

The empirical values indicate that motor-side and opposite-motor-side outlet angles 30 and 31 are 160° to 175°, that motor-side and opposite-motor-side inlet angles 56 and 57 are 95° to 110°, and that these angles 30, 31, 56, and 57 generally increase with increasing required static pressure. When double inlet centrifugal fan 75 of the seventh embodiment is used in the case that pressure loss in the air passage to fan inlet port 29 is large, the blades have a large increase in total pressure and high static pressure characteristics. This results in compact double inlet centrifugal fan 75 capable of supplying the required air flow.

It has turned out that when the required static pressure is high, it is preferable to increase by about 5° each of motor-side and opposite-motor-side outlet angles 30 and 31 and motor-side and opposite-motor-side inlet angles 56 and 57.

In FIG. 8, the impeller has been confirmed to have high static pressure characteristics when the blades have an outlet angle of 178° at the air outlet end and an inlet angle of 115° at the air inlet end. Therefore, the outlet angle at the air outlet end of the blades is preferably 160° to 178°, and the inlet angle at the air inlet end of the blades is preferably 95° to 115°. This allows blades 25 to have a large increase in total pressure and high static pressure characteristics. This results in impeller 93 used in compact double inlet centrifugal fan 75 capable of supplying the required air flow.

INDUSTRIAL APPLICABILITY

Besides air conveying systems such as ventilators, air conditioners, dehumidifiers, humidifiers, and air cleaners, the present invention can be compactly installed in devices so as to cool them with high cooling performance by using the air flow drawn through a unit air outlet at a low pressure loss to ensure sufficient air flow.

The invention claimed is:

1. A double inlet centrifugal fan comprising:

a fan casing including an outlet port, a spiral scroll, and casing side plates on both side surfaces of the fan casing, each of the casing side plates having an orifice with a casing inlet port;

an impeller including a disk-shaped main plate connected to a drive shaft in the fan casing, annular fan side plates on both sides of the main plate, and a plurality of blades between the main plate and each of the fan side plates; and fan inlet port having an opening corresponding to an inner diameter of the blades, wherein the inner diameter of the blades on a side of a larger pressure loss in a suction air passage to the fan inlet port is smaller than the inner diameter of the blades on a side of a smaller pressure loss.

2. The double inlet centrifugal fan of claim 1, wherein the blades on the side of the larger pressure loss in the suction air passage to the fan inlet port have a smaller inner circumferential area than the blades on the side of the smaller pressure loss have.

3. The double inlet centrifugal fan of claim 1, wherein the scroll on the side of the larger pressure loss in the suction air passage to the fan inlet port has a smaller enlarged angle than the scroll on the side of the smaller pressure loss has.

4. The double inlet centrifugal fan of claim 1, wherein in the blades on both sides of the main plate of the impeller, the blades on the side of the larger pressure loss in the suction air passage to the fan inlet port are shorter than the blades on the side of the smaller pressure loss.

5. The double inlet centrifugal fan of claim 3, wherein the scroll is divided in a same plane as the main plate of the impeller.

6. The double inlet centrifugal fan of claim 3, wherein the scroll is inclined with respect to the drive shaft of the impeller.

7. The double inlet centrifugal fan of claim 4, wherein each of the blades on the side of the larger pressure loss in the suction air passage to the fan inlet port has a 38% to 80% length of the blade on the side of the smaller pressure loss.

8. The double inlet centrifugal fan of claim 4, wherein each of the blades has a 20% to 80% length of an outer diameter of the blade.

9. The double inlet centrifugal fan of claim 1, wherein the blades have an outlet angle of 160° to 178° at an air outlet end.

10. The double inlet centrifugal fan of claim 1, wherein the blades have an inlet angle of 95° to 115° at an air inlet end.

11. A double inlet centrifugal fan comprising:

a fan casing having a first casing inlet port and a second casing inlet port;

an impeller disposed in the fan casing, the impeller including a first plurality of blades and a second plurality of blades; and a motor operatively coupled to the impeller and disposed near the first casing inlet port, wherein an inner diameter of the first plurality of blades near the motor is smaller than an inner diameter of the second plurality of blades.

12. The double inlet centrifugal fan of claim 11, wherein the fan casing further includes an outlet port provided in a direction substantially perpendicular to a rotating axis of the impeller, wherein the first casing inlet port and the second casing inlet port are provided substantially in a direction of the rotating axis of the impeller.

13. The double inlet centrifugal fan of claim 11, wherein a diameter of the first casing inlet port provided near the motor is substantially corresponding to the inner diameter of the first plurality of blades.

14. The double inlet centrifugal fan of claim 11, wherein the impeller further comprises:

a disk-shaped main plate operatively coupled to the motor; and a first annular fan side plate provided on a first side of the main plate and a second annular fan side plate provided on a second side of the main plate, wherein the first plurality of blades is provided between the main plate and the first annular fan side plate and the second plurality of blades is provided between the main plate and the second annular fan side plate, wherein fan inlet ports having openings corresponding to the inner diameter of the blades are provided on the first and second fan side plates.

15. The double inlet centrifugal fan of claim 11, wherein the fan casing further comprises a spiral scroll, wherein the impeller is provided in the spiral scroll.

16. The double inlet centrifugal fan of claim 11, wherein the fan casing further comprises a casing side plate and an orifice along the casing inlet port.

17. The double inlet centrifugal fan of claim 11, wherein a length of the first plurality of blades is less than a length of the second plurality of blades.

18. The double inlet centrifugal fan of claim 11, wherein each of the first and second pluralities of blades has an outlet angle of 160° to 178° at an air outlet end.

19. The double inlet centrifugal fan of claim 11, wherein each of the first and second pluralities of blades has an inlet angle of 95° to 115° at an air inlet end.

* * * * *